US011346506B2

(12) United States Patent
Cao et al.

(10) Patent No.: US 11,346,506 B2
(45) Date of Patent: May 31, 2022

(54) LED LIGHT BULB

(71) Applicant: XIAMEN ECO LIGHTING CO. LTD., Xiamen (CN)

(72) Inventors: Liangliang Cao, Xiamen (CN); Yuxin Huang, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 17/062,070

(22) Filed: Oct. 2, 2020

(65) Prior Publication Data

US 2021/0018146 A1 Jan. 21, 2021

Related U.S. Application Data

(63) Continuation of application No. 16/872,184, filed on May 11, 2020, now Pat. No. 10,830,396, which is a continuation of application No. 16/432,919, filed on Jun. 5, 2019, now Pat. No. 10,690,292.

(30) Foreign Application Priority Data

Mar. 14, 2019 (CN) ..... 201920325815.5

(51) Int. Cl.

| | |
|---|---|
| ***F21K 9/232*** | (2016.01) |
| ***F21V 29/70*** | (2015.01) |
| ***F21K 9/66*** | (2016.01) |
| ***F21K 9/238*** | (2016.01) |
| ***F21K 9/235*** | (2016.01) |
| ***H05B 45/20*** | (2020.01) |
| ***F21Y 113/13*** | (2016.01) |
| ***F21Y 115/10*** | (2016.01) |
| ***F21Y 107/70*** | (2016.01) |

(52) U.S. Cl.

CPC ..... *F21K 9/232* (2016.08); *F21K 9/235* (2016.08); *F21K 9/238* (2016.08); *F21K 9/66* (2016.08); *F21V 29/70* (2015.01); *H05B 45/20* (2020.01); *F21Y 2107/70* (2016.08); *F21Y 2113/13* (2016.08); *F21Y 2115/10* (2016.08)

(58) Field of Classification Search

CPC ... F21K 9/32; F21K 9/66; F21K 9/238; F21K 9/235; F21V 29/70; H05B 45/20

USPC ..... 362/231

See application file for complete search history.

(56) References Cited

U.S. PATENT DOCUMENTS

| | | | | |
|---|---|---|---|---|
| 10,281,129 | B1 * | 5/2019 | Lai | H01R 33/22 |
| 2008/0137360 | A1 * | 6/2008 | Van Jijswick | F21K 9/66 362/555 |
| 2009/0086501 | A1 * | 4/2009 | Devir | H01K 9/08 362/519 |

(Continued)

*Primary Examiner* — Bryon T Gyllstrom

(74) *Attorney, Agent, or Firm* — Chun-Ming Shih; Lanway IPR Services

(57) ABSTRACT

An light bulb includes a bulb housing, a heat sink, and a head housing arranged in series along a longitudinal axis of the light bulb. The light bulb includes a first filament having a first LED chip capable of emitting a first light with a first color characteristic, and a second filament having a second LED chip capable of emitting a second light with a second color characteristic. The first filament and the second filament are spiral along a transverse axis perpendicular to the longitudinal axis of the light bulb. The light bulb further includes a driving module configured to enable one or a combination of the first filament and the second filament to emit light.

20 Claims, 12 Drawing Sheets

(56) References Cited

U.S. PATENT DOCUMENTS

| | | | | |
|---|---|---|---|---|
| 2014/0355292 | A1* | 12/2014 | Krause | G02B 6/001 362/555 |
| 2015/0085489 | A1* | 3/2015 | Anderson | F21K 9/232 362/249.06 |
| 2016/0041324 | A1* | 2/2016 | Nava | F21K 9/61 362/311.01 |
| 2017/0012177 | A1* | 1/2017 | Trottier | F21K 9/00 |
| 2019/0242535 | A1* | 8/2019 | Hikmet | H05B 47/19 |

* cited by examiner

LED LIGHT BULB

FIELD

The present invention is related to an LED light bulb, and more particularly related to an LED light bulb with flexible filaments transversely arranged in the bulb housing.

BACKGROUND

At present, with the further progress of LED technology, it has achieved more and better development in the field of room lighting design. As a result, LED has become very popular in the room lighting design. This not only meets the needs of lighting, but also gradually contributes to energy-saving, the development of health, art and humanity.

For most of the conventional LEDs flexible filament light bulbs, the flexible filaments are of vertical spiral arrangements. The light distribution of this scheme is relatively limited, and the light beams emitted from the top of the LEDs are relative less. In addition, most of the LEDs are monochromatic or with only one color temperature, so the applications are also limited.

SUMMARY OF INVENTION

The present disclosure relates to an LED light bulb for proving improved light distribution of the LED flexible filament light bulb and for enhancing the applicable scenarios.

In one embodiment, the light bulb includes a driving module, at least two flexible filaments, and a bulb housing enclosing the filaments. The driving module includes a driving circuitry. Each of the flexible filaments has an LED chip and is capable of emitting light with a different light characteristics from each other, each of the flexible filaments is spiral along a transverse axis of the light bulb, and is independently electrically connected to the driving circuitry.

The bulb housing is configured to diffuse the light emitted by the flexible filaments.

The light characteristics may be color, or color temperature.

The flexible filaments are interspersedly spiral along the transverse axis of the bulb housing.

The driver circuitry may include a current provider and a selection circuitry. The current provider is configured to provide currents to the flexible filaments. The selection circuitry is configured to selectively provide electrically connection between the current provider and the flexible filaments.

The driver circuitry may further include a tuning circuitry configured to control the current provider to provide the currents to the flexible filaments for emitting light of a desired luminance.

The tuning circuitry is configured to control the current provider to provide the currents to the flexible filaments so each of the flexible filaments emits light with a different luminance.

The light bulb further includes a head housing having a screw-type adaptor and a power source contact. The screw-type adaptor and the power source contact are electrically insulating to each other, and the screw-type adaptor and the power source contact are respectively electrically connected to the driving module.

In some embodiments, the light bulb includes a bulb housing, a heat sink, and a head housing arranged in series along a longitudinal axis of the light bulb. The light bulb further includes a first filament having a first LED chip capable of emitting a first light with a first color characteristic, and a second filament having a second LED chip capable of emitting a second light with a second color characteristic. The first filament and the second filament are spiral along a transverse axis perpendicular to the longitudinal axis of the light bulb. The light bulb further includes a driving module configured to enable one or a combination of the first filament and the second filament to emit light.

The bulb housing may include light transmissive material, and is configured to diffuse the first light emitted by the first filament and the second light emitted by the second filament.

The light bulb may further include a core pillar. The core pillar includes a base, a first conductor frame, and a second conductor frame. The base of the core pillar is coupled to an opening of the bulb housing. The first conductor frame is electrically connected between the driving module and the first filament, and the second conductor frame is electrically connected between the driving module and the second filament.

The head housing may include a screw-type adaptor and a power source contact, the screw-type adaptor and the power source contact are electrically insulating to each other, and the screw-type adaptor and the power source contact are respectively electrically connected to the driving module.

The driver module may include a current provider and a selection circuitry. The current provider is configured to provide currents to the first filament and the second filament. The selection circuitry is configured to selectively provide electrically connection between the current provider and the first filament, and between the current provider and the second filament.

The driver circuitry may further include a tuning circuitry configured to control the current provider to provide the currents to the first and second filaments for emitting light of a desired luminance.

The tuning circuitry may be configured to control the current provider to provide the currents to the first and the second filament so each of the filaments emits light with a different luminance.

In some embodiments, the first light is red light and the second light is yellow light. In some embodiments, the first light has a first color temperature, and the second light has a second color temperature different from the first color temperature.

The light bulb may further include a third filament having a third LED chip capable of emitting a third light with a third color characteristic. The first filament, the second filament, and the third filament are spiral along the transverse axis.

In some embodiments, the first light is red light, the second light is yellow light, and third light is blue light. In some embodiments, the first light has a first color temperature, the second light has a second color temperature, the third light has a third color temperature. The first color temperature, the second color temperature, and the third color temperature are different from each other.

DETAILED DESCRIPTION

The present disclosure will be further described in detail below with reference to the accompanying drawings and embodiments. It is understood that the specific embodiments described herein are merely illustrative of the claimed invention and are not intended to limit the claimed invention.

Figure 1:
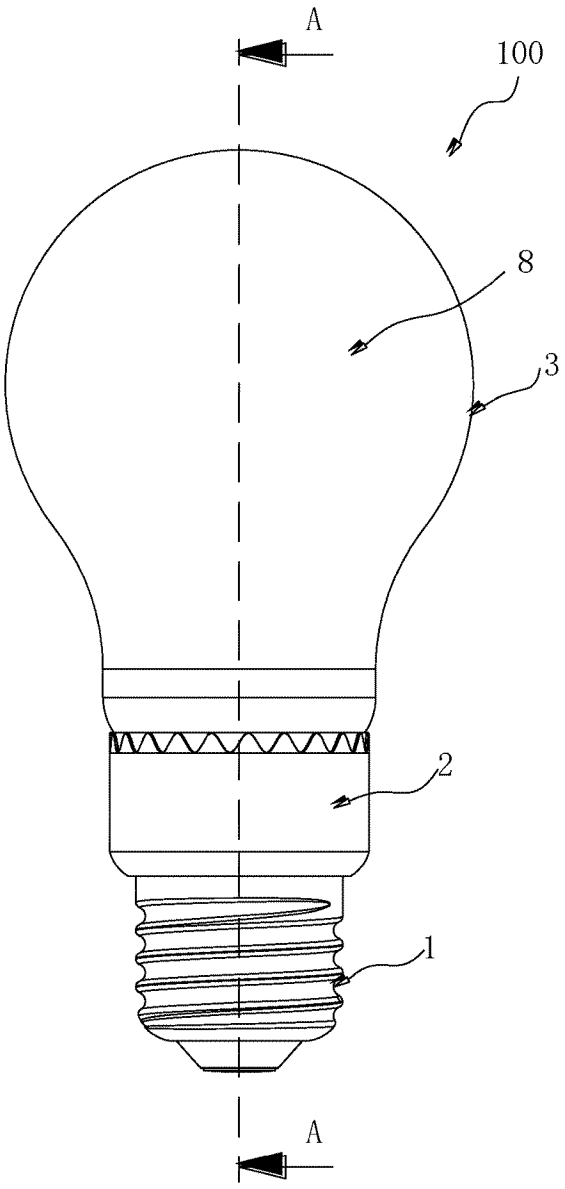
FIG. 1 is a schematic view of the LED light bulb in accordance with a first embodiment of the present disclosure.
Figure 2:
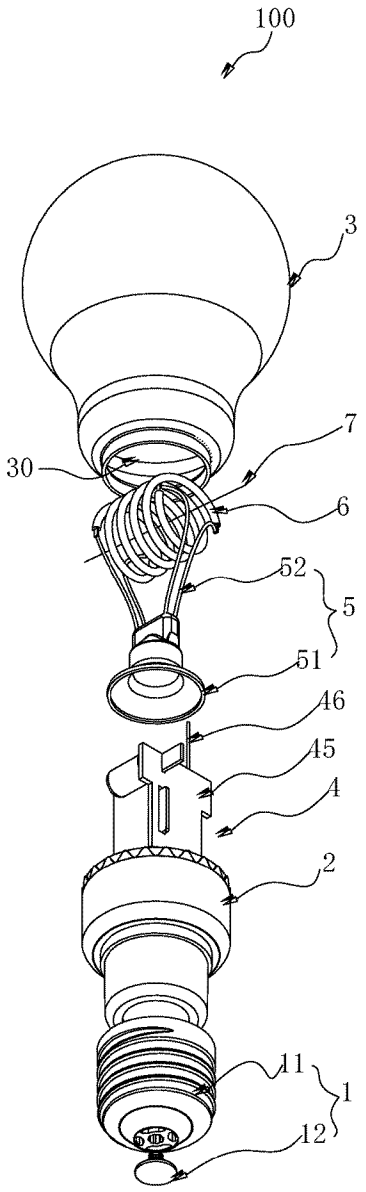
FIG. 2 is an exploded view of the LED light bulb in accordance with the first embodiment of the present disclosure.
Figure 3:
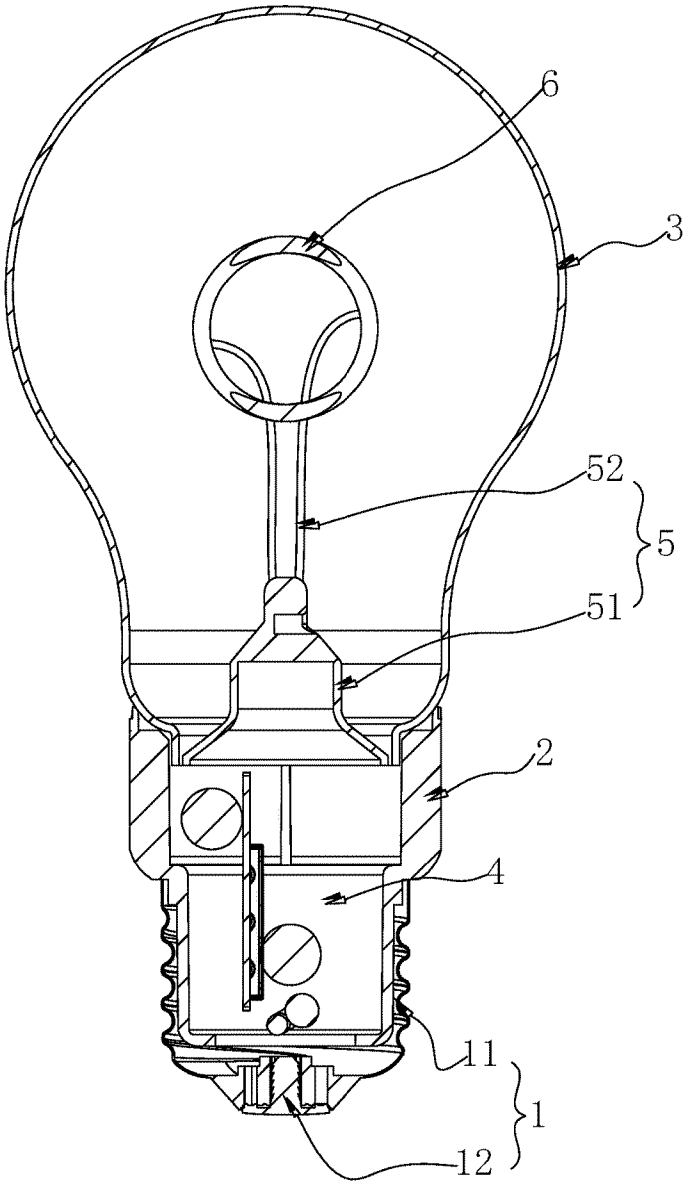
FIG. 3 is a cross-sectional view of the LED light bulb in FIG. 1 along the A-A line.

Refer to FIG. 1 to 3. In a first embodiment, the light bulb 100 includes a bulb housing 3, a heat sink 2, and a head housing 1 arranged in series along a longitudinal axis A-A of the light bulb 100. The heat sink 2 and the blub housing 3 form a cavity 8. The light bulb 100 includes a driving module 4 and at least two flexible filaments 6, and the bulb housing 3 encloses the flexible filaments 6. The driving module 4 includes a driving circuitry 40 (not shown in FIG. 1-3) to provide driving currents to the flexible filaments 6. Each of the flexible filaments 6 has at least an LED chip, and is capable of emitting light with a different light characteristic from each other. The light characteristic may be color (for example, red, green, or blue), or color temperature (for example, 2800K, 4000K, or 6000K). Each of the flexible filaments 6 may be independently turned on or turned off by the driving circuitry 40. Each of the flexible filaments 6 is spiral along a transverse axis 7 of the light bulb, and is independently electrically connected to the driving circuitry 40. The flexible filaments 6 are spiral along the transverse axis 7.

The heat sink 2 may be made of aluminum to efficiently distribute the heat generated by the driving module 4 and the flexible filaments 6, and ensure that the driving module 4 and the flexible filaments 6 may operate properly. The bulb housing 3 is configured to diffuse the LED light bulb of the flexible filaments 6. In this way, the light beams of the flexible filaments 6 are uniformly mixed and then radiate out to enhance the lighting performance.

The colors and/or color temperatures of the flexible filaments 6 may be different. Thus, one or a plurality of the flexible filaments 6 may be used according to the colors or the color temperatures required so as to realize the light performance of different colors or luminous flux. This increases the applicable scenarios of the light bulb 100. In addition, each of the flexible filaments 6 is of a horizontal-spiral shape, which can increase the amount of light beams emitted from the top of the LED, so the overall light output is more uniform and meets the general lighting requirements.

The flexible filaments 6 include at least a flexible circuit board (not shown) and LED emission components (not shown). The color or the color temperature of the flexible filaments 6 may be determined by the color or the color temperature of the LED emission components.

Refer to FIG. 2, the light bulb 100 also includes a head housing 1 having a screw-type adaptor 11 and a power source contact 12. The screw-type adaptor 11 and the power source contact 12 are electrically insulating to each other, and the screw-type adaptor 11 and the power source contact 12 are respectively electrically connected to the driving module 4.

As shown in FIG. 2, one end of the bulb housing 3 is configured with an opening 30. The heat sink 2 is installed around the opening 30 of the bulb housing 3. The bulb housing 3 is configured to uniformly mix the light beams of the flexible filaments 6, and then the light beams are emitted outward. The heat sink 2 may be made of aluminum materials to efficiently distribute the heat generated by the driving module 4 and the flexible filaments 6, such that the driving module 4 and the flexible filaments 6 may operate properly.

Refer to FIG. 2. The driving module 4 may include a substrate 45. The driving circuitry 40 is disposed on the substrate 45. The substrate 45 is provided with a plurality of connection terminals 46 for establishing a current loop between a constant-current provider 41 and the flexible filaments 6.

The bulb housing 3 is made of light transmissive material, and is configured to diffuse the light emitted by the flexible filaments 6.

Refer to FIG. 2. The light bulb 100 includes a core pillar 5. The driving module 4 and the flexible filaments 6 are electrically connected via the core pillar 5. The core pillar 5 includes a base 51, and conductor frames 52. The base 51 is fixed within the opening 30 of the bulb housing 3, and the conductor frames 52 is fixed on the base 51. Each of the flexible filaments 6 is electrically connected to the driving module 4 via the conductor frames 52. When the base 51 and the conductor frames 52 are fixed, the flexible filaments 6 may also be stably fixed.

The base 51 may be fixed inside the opening 30 of the bulb housing 3, or may be fixed onto the heat sink 2 arranged inside the opening 30. It is preferable that the base 51 be fixed with respect to the heat sink 2. In one embodiment, the base 51 is arranged on the heat sink 2 by screw lock or the like.

As shown in FIG. 2, the base 51 is trumpet-shaped. A first end of the base 51 is arranged around the heat sink 2, and a second end of the base 51 is arranged around the flexible filaments 6. The width of the first end of the base 51 is greater than the width of the second end of the base 51. In an example, the conductor frames 52 passes through the internal of the base 51 and the second end of the base 51 in sequence so as to connect to the flexible filaments 6.

The core pillar 5 includes a plurality of sets of conductor frames 52. The two conductor frames 52 connect to two ends of one flexible filament 6 is configured as the same set, which is configured to establish one current loop between the flexible filament 6 and the two conductor frames 52. Thus, the number of the set of the conductor frames 52 is the same with the number of the flexible filaments 6. The sets of the conductor frames 52 are connected in parallel, and thus the flexible filaments 6 are connected in parallel.

In applicable scenarios, the conductor frames 52 may be conductive wires, preferably rigid conductive wires. The diameter of the conductor frames 52 may be larger, or the periphery of the conductive wires may also be surrounded by the insulating material to form a support layer or the like. With such configuration, the flexible filaments 6 may be properly supported.

Figure 10:
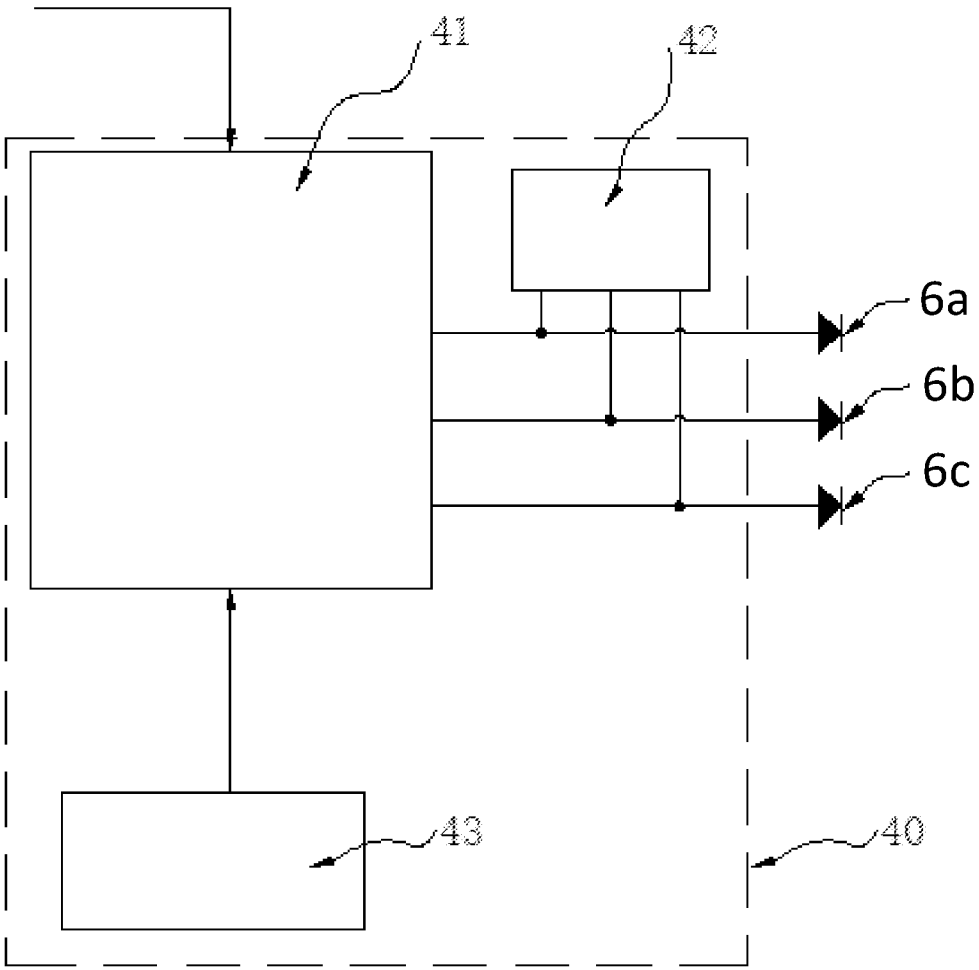
FIG. 10 is a schematic view showing the driving relationship of the LED light bulb of the LED light bulb in accordance with the third embodiment of the present disclosure.

Referring to FIG. 10, the driver circuitry 40 may include a current provider 41 and a selection circuitry 42. The current provider 41 is configured to provide currents to the flexible filaments 6.

The constant-current provider 41 is configured to convert the input alternate current (AC) into direct current (AC) and to reduce and/or stabilize the voltage of the AC. As such, the flexible filaments 6 may receive proper power supply and operate normally.

As shown in FIG. 10, the selection circuitry 42 is configured to selectively provide electrically connection between the current provider 41 and the flexible filaments 6.

Also shown in FIG. 10, in this embodiment, the driver circuitry 40 further includes a tuning circuitry 43 configured to control the current provider 41 to provide the currents to the flexible filaments 6 for emitting light of a desired luminance. Further, the tuning circuitry 43 may control the current provider 41 to provide different currents to different flexible filaments 6, so each of the flexible filaments 6 emits light with a different luminance.

Figure 4:
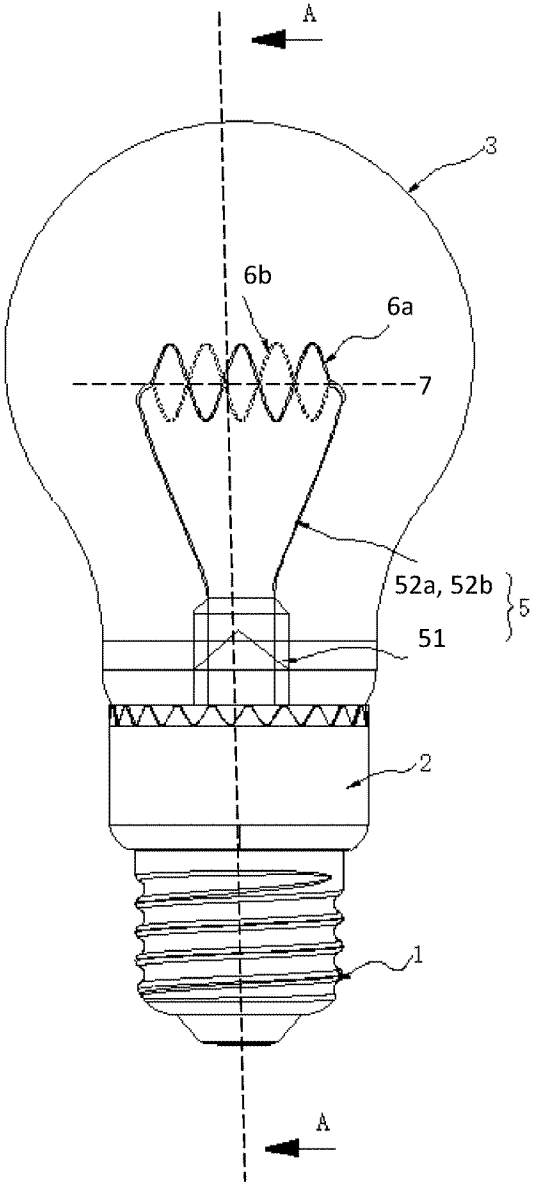
FIG. 4 is a front view of the LED light bulb in accordance with a second embodiment of the present disclosure.
Figure 5:
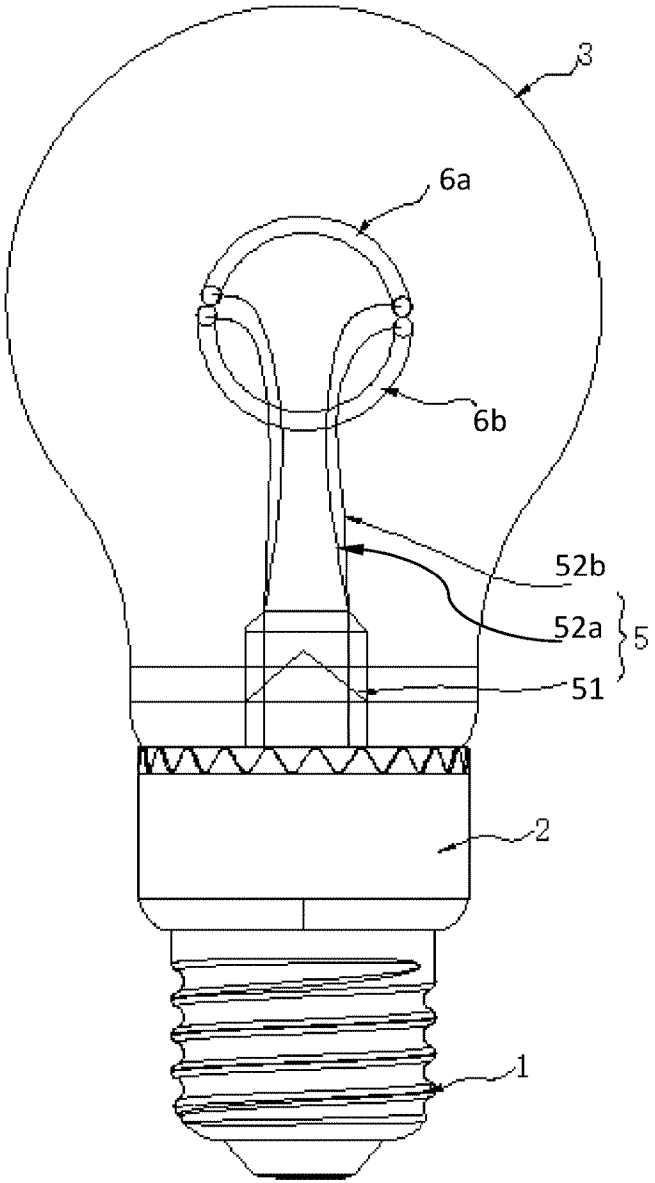
FIG. 5 is a side view of the LED light bulb in accordance with the second embodiment of the present disclosure.
Figure 6:
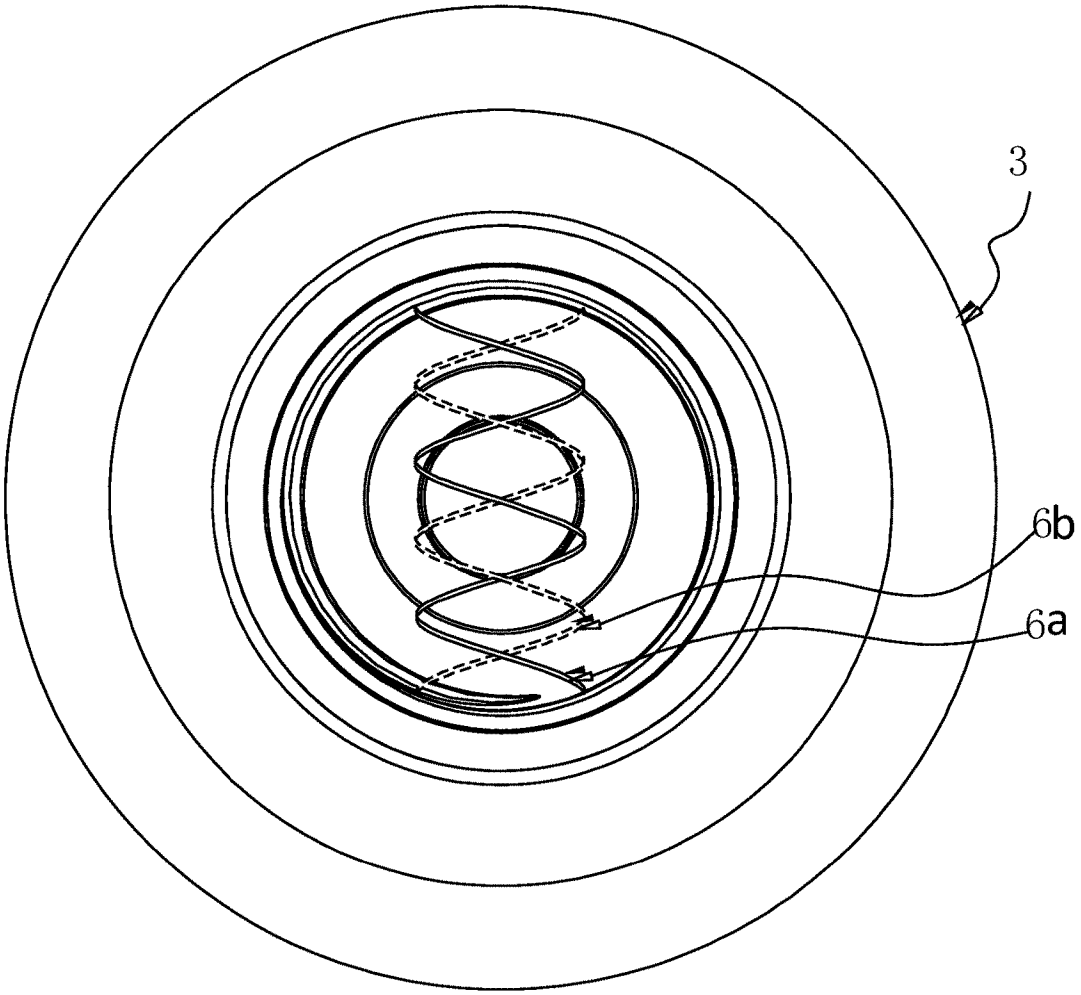
FIG. 6 is a top view of the LED light bulb in accordance with the second embodiment of the present disclosure.

FIG. 4-6 illustrates the second embodiment of the invention. In this embodiment, the flexible filaments 6 are interspersedly spiral along the transverse axis 7. In this way, each of the flexible filaments 6 may be uniformly configured within the bulb housing 3, and two flexible filaments 6 may also be uniformly configure along the horizontal direction with respect to the transverse axis 7. Therefore, the lighting performance of the light bulb 100 may be uniform regardless the number of the flexible filaments 6 that have been turned on. Specifically, each of the flexible filaments 6 may be configured to be spiral along the transverse axis 7. Viewing in a plane on which the transverse axis 7 is located, the plurality of flexible filaments 6 are sequentially arranged in a loop.

Figure 11:
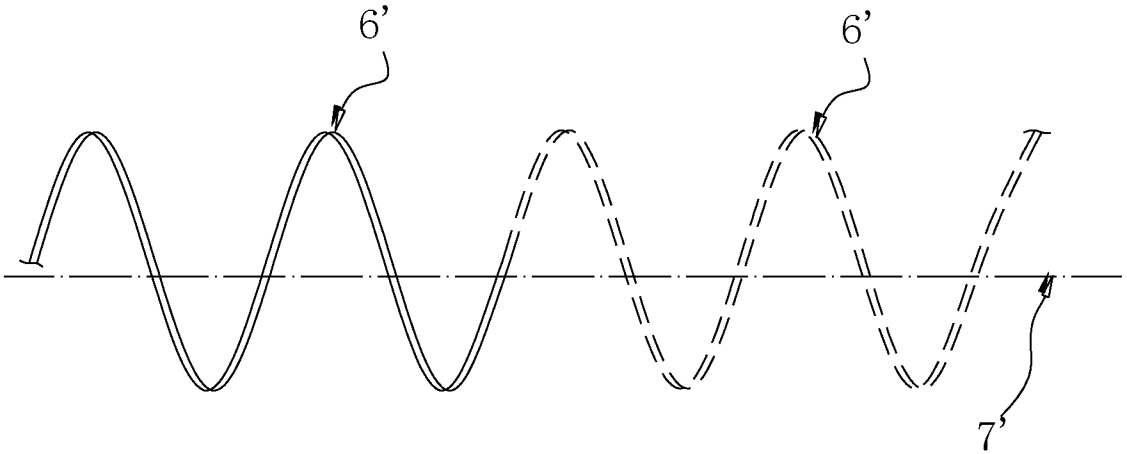
FIGS. 11 and 12 are schematic views showing the comparisons between the spiral structures.
Figure 12:
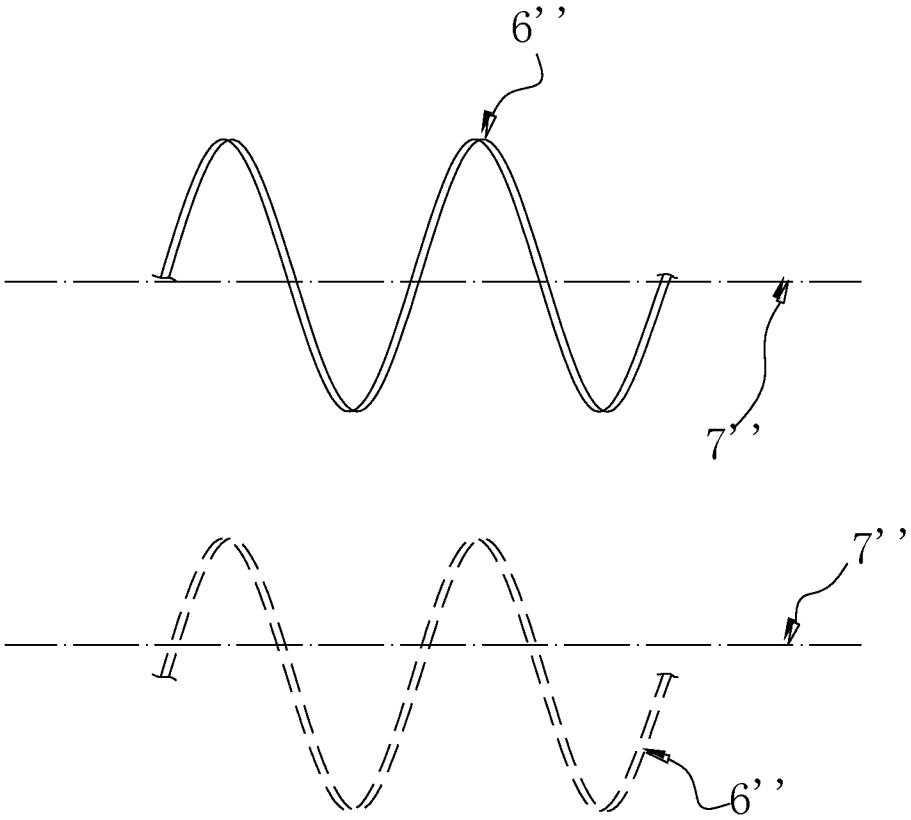

The interspersedly spiral structure may be further illustrated by referring to FIGS. 11 and 12. In FIG. 11, one flexible filament 6' and another flexible filament 6' are extended along the spiral transverse axis 7' in sequence, but the two flexible filaments 6, 6' are not interspersedly spiral. In FIG. 12, the two flexible filaments 6" are respectively extended along the spiral transverse axis 7", and the two flexible filaments 6" are parallel to each other. Also, the two flexible filaments 6" are not interspersedly spiral. It can be understood that, in FIGS. 11 and 12, when only one of the flexible filaments 6, 6" is turned on, the lighting performance is not uniform.

In the second embodiment, the light bulb 100 includes a first filament 6*a* having a first LED chip capable of emitting a first light with a first color characteristic, and a second filament 6*b* having a second LED chip capable of emitting a second light with a second color characteristic. The first filament 6*a* and the second filament 6*b* are spiral along a transverse axis 7 perpendicular to the longitudinal axis A-A of the light bulb 100. As shown in FIG. 4-6, both ends of the first filament 6*a* are soldered to a first conductor frame 52*a*, and both ends of the second filament 6*b* are soldered to the second conductor frame 52*b*.

The light bulb 100 further includes a driving module 4 configured to enable one or a combination of the first filament 6*a* and the second filament 6*b* to emit light.

Similar to the first embodiment, the bulb housing 3 may include light transmissive material, and is configured to diffuse the first light emitted by the first filament 6*a* and the second light emitted by the second filament 6*b*.

Refer to FIG. 5. In the second embodiment, the light bulb 100 includes a core pillar 5. The core pillar 5 includes a base 51, a first conductor frame 52*a*, and a second conductor frame 52*b*. The base 51 of the core pillar 5 is coupled to an opening 30 of the bulb housing 3. The first conductor frame 52*a* is electrically connected between the driving module 4 and the first filament 6*a*, and the second conductor frame 52*b* is electrically connected between the driving module 4 and the second filament 6*b*.

Similar to the first embodiment, as shown in FIG. 10, the driver module 4 includes a driving circuitry 40. The driving circuitry 40 may include a current provider 41 and a selection circuitry 42. The current provider 41 is configured to provide currents to the first filament 6*a* and the second filament 6*b*. The selection circuitry 42 is configured to selectively provide electrically connection between the current provider 41 and the first filament 6*a*, and also between the current provider 41 and the second filament 6*b*.

The driver circuitry 40 further includes a tuning circuitry 43 configured to control the current provider 41 to provide the currents to the first filament 6*a* and the second filament 6*b* for emitting light of a desired luminance. In some embodiments, the tuning circuitry 40 is configured to control the current provider 41 to provide the currents to the first filament 6*a* and the second filament 6*b*, so each of the filaments 6*a*, 6*b* could emit light with a different luminance.

In one circumstance, both of the two flexible filaments 6 emit white light, but the white light are with different color temperature. For example, the color temperature of the two flexible filaments 6 may be respectively in a range between 2600 K~3500K and above 5000K. Three color temperature may be obtained by switching on one or both of the two flexible filaments 6. In an example, the color temperature of the two flexible filaments 6 may be 2700K and 5500K. Thus, the color temperature may be configured in accordance with the applicable scenario.

In another example, the colors of the two flexible filaments 6 are different, e.g., red light and yellow light respectively corresponding to the red LED chip and yellow LED chip. Thus, three applicable scenarios may be obtained, that is, red light, yellow light, a mixture of the red light and the yellow light.

It can be understood that in another embodiment, the light bulb 100 may include two white light flexible filaments 6 with different color temperatures, and one non-white light flexible filament 6, such as a yellow light flexible filament.

Figure 7:
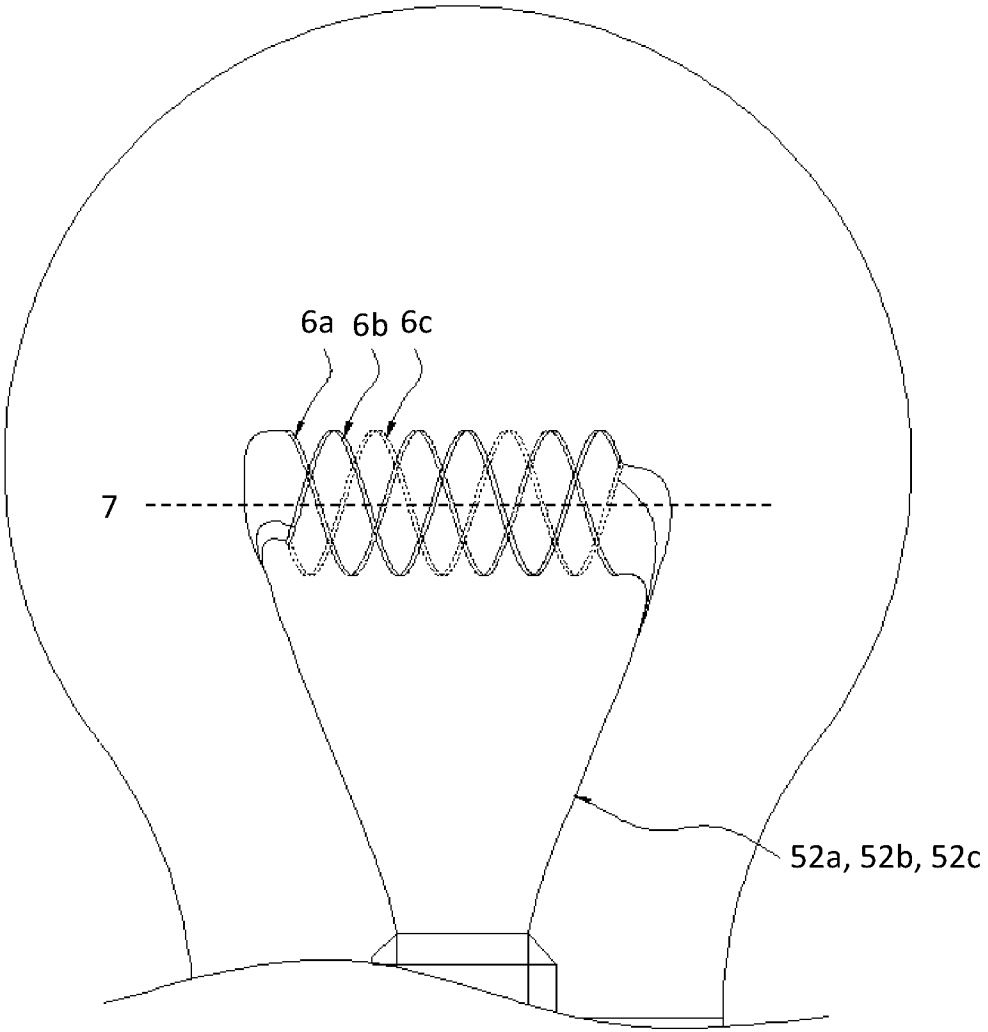
FIG. 7 is a front view of the flexible filaments of the LED light bulb in accordance with a third embodiment of the present disclosure.
Figure 8:
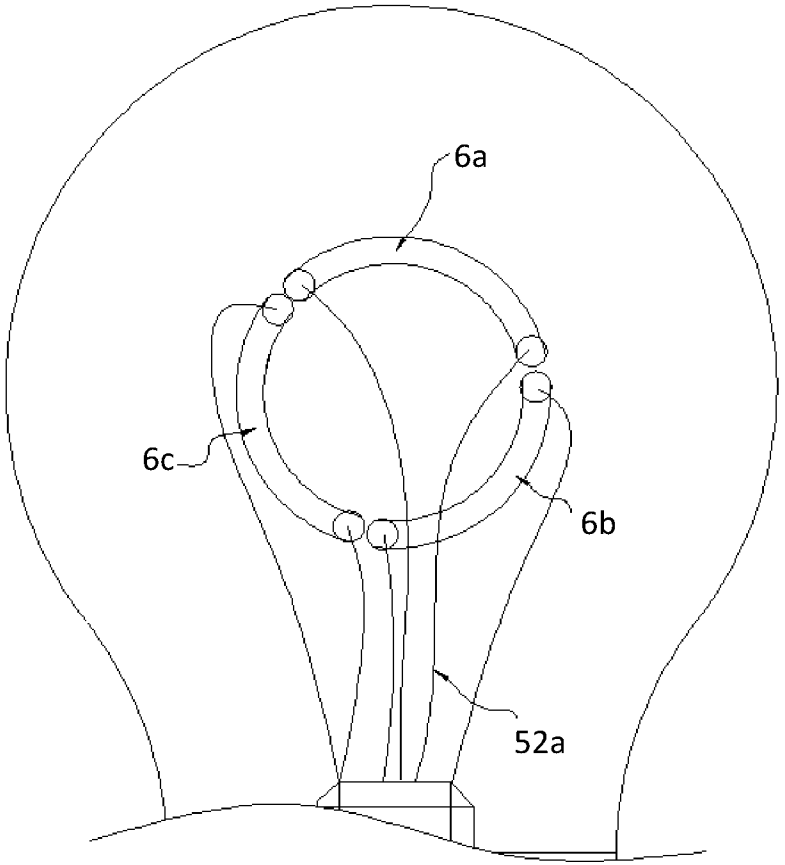
FIG. 8 is a top view of the flexible filaments of the LED light bulb in accordance with the third embodiment of the present disclosure.
Figure 9:
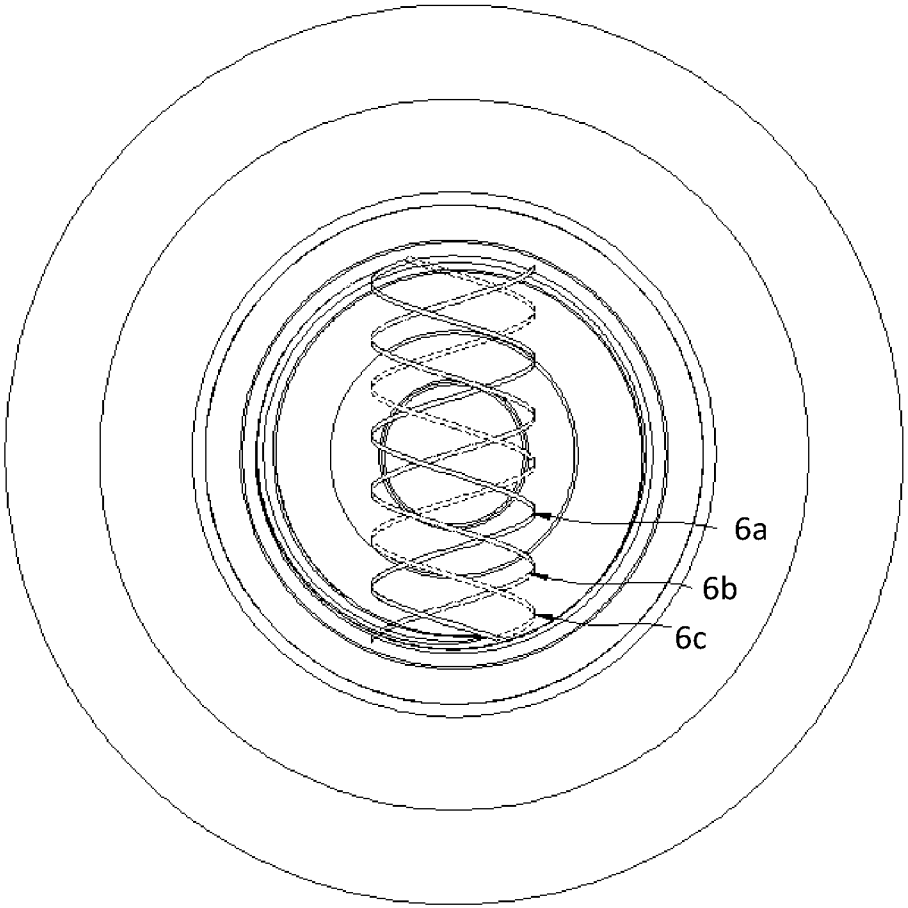
FIG. 9 is a front view of the flexible filaments of the LED light bulb in accordance with the third embodiment of the present disclosure.

FIG. 7-9 illustrates the third embodiment of the invention. In the third embodiment, the LED light bulb 100 includes three flexible filaments 6*a*, 6*b*, and 6*c*. Both ends of the filaments 6*a*, 6*b*, and 6*c* are soldered to the conductor frames 52*a*, 52*b*, and 52*c* respectively.

In the third embodiment, the light bulb 100 includes a first filament 6*a* having a first LED chip capable of emitting a first light with a first color characteristic, a second filament 6*b* having a second LED chip capable of emitting a second light with a second color characteristic, and a third filament 6*c* having a third LED chip capable of emitting a third light with a third color characteristic. The first filament 6*a*, the second filament 6*b*, and the third filament 6*c* are spiral along the transverse axis 7.

In another example, the first filament 6*a*, the second filament 6*b*, and the third filament 6*c* may emit white light with different color temperatures. For example, the color temperatures of the first filament 6*a*, the second filament 6*b*, and the third filament 6*c* may respectively be in a range between 2600K~3500K, in a range between 3500K~5000K, and above 5000K. There may be totally seven color temperatures obtained by switching on one or a combination of the first filament 6*a*, the second filament 6*b*, and the third filament 6*c*. Specifically, the color temperatures of the first filament 6*a*, the second filament 6*b*, and the third filament 6*c* may respectively be 2700K, 4000K, and 5500K. It can be understood that other color temperatures may also be configured according to the applicable scenario.

In another example, the lights emitted by the first filament 6*a*, the second filament 6*b*, and the third filament 6*c* are of different colors. For example, the first filament 6*a*, the second filament 6*b*, and the third filament 6*c* respectively emits red light, green light, and blue light via the red LED chip, green LED chip, and blue LED chip. It can be understood that other colors may also be configured according to applicable scenario.

In one embodiment, as shown in FIG. 10, the first filament 6*a*, the second filament 6*b*, and the third filament 6*c* are controlled by the selection circuitry 42. The driving circuitry 40 further includes the selection circuitry 42 connected between the constant-current provider 41 and the first filament 6*a*, the second filament 6*b*, and the third filament 6*c*. As such, the first filament 6*a*, the second filament 6*b*, and the third filament 6*c* may be independently controlled.

In one example, the selection circuitry 42 includes a single-chip microcomputer having a power pin, a control pin, and a plurality of output pins respectively corresponding to one output end of the constant-current provider 41 and one flexible filament 6. The control pin connects to external switch, and the power pin connects to the power output circuity. The control pins output different control signals when the switch is turned on, so as to turn on or off the output pins. As such, the first filament 6*a*, the second filament 6*b*, and the third filament 6*c* are connected with the output end of the constant-current provider 41 to turn on/off the corresponding first filament 6*a*, second filament 6*b*, or third filament 6*c*. With such configuration, the driving module of the light bulb 100 may be simplified so as to reduce the dimension and the cost of the light bulb 100.

In one example, at least one switching thin film transistor (TFT) is configured between the first filament 6*a*, the second filament 6*b*, the third filament 6*c*, the output end of the constant-current provider 41, and the output pins of the single-chip microcomputer. In addition, different selection circuitry 42 may be configured accordingly.

In an example, the three flexible filaments 6 are respectively a red filament 6*a* (R), a green filament 6*b* (G), and a blue filament 6*c* (B). The flexible filaments of the single-chip microcomputer may be selected as shown in Table. 1, so as to obtain a mixture of the colors by selecting one or a combination of the flexible filaments 6 of different colors.

TABLE 1

Control table of the single-chip microcomputer

| | color temperature | | | | | | |
|---|---|---|---|---|---|---|---|
| | white | yellow | red | green | cyan-blue | blue | magenta |
| R | 1 | 1 | 1 | 0 | 0 | 0 | 1 |
| G | 1 | 1 | 0 | 1 | 1 | 0 | 0 |
| B | 1 | 0 | 0 | 0 | 1 | 1 | 1 |

In one embodiment, as shown in FIG. 10, the driving circuitry 40 further includes a tuning circuitry 43 connecting to the constant-current provider 41. The current from the output end of the constant-current provider 41 is controlled so as to control the luminous flux of the LED chips of each of the first filament 6*a*, the second filament 6*b*, and the third filament 6*c*. The tuning circuitry 43 may be a pulse width modulation (PWM) circuitry 43, which is configured to guarantee the color temperature or the colors when it is desired to change the luminous flux of the light bulb 100.

It can be understood that, in another embodiment, the light bulb 100 includes not only the red filament 6*a* (R), the green filament 6*b* (G), and the blue filament 6*c* (B), but also the flexible filaments 6*d*, 6*e* capable of emitting the white light of different color temperatures.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A light bulb, comprising:

a driving module including a driving circuitry;

at least two flexible filaments, each of the flexible filaments has an LED chip and is capable of emitting light with a different light characteristic from each other, each of the flexible filaments is spiral and intertwined together along a same transverse axis of the light bulb, wherein the flexible filaments are fixed to a conductor frames for electrically connecting to the driving circuitry; and a bulb housing enclosing the filaments.

2. The light bulb of claim 1, wherein the bulb housing is configured to diffuse the light emitted by the flexible filaments.

3. The light bulb of claim 1, wherein the light characteristics is color.

4. The light bulb of claim 1, wherein the light characteristics is color temperature.

5. The light bulb of claim 1, wherein each of the flexible filaments is independently electrically connected to the driving circuitry.

6. The light bulb of claim 1, wherein the driver circuitry includes a current provider and a selection circuitry, the current provider is configured to provide currents to the flexible filaments, and the selection circuitry is configured to selectively provide electrically connection between the current provider and the flexible filaments.

7. The light bulb of claim 6, wherein the driver circuitry further comprises a tuning circuitry configured to control the current provider to provide the currents to the flexible filaments for emitting light of a desired luminance.

8. The light bulb of claim 7, wherein the tuning circuitry is configured to control the current provider to provide the currents to the flexible filaments so each of the flexible filaments emits light with a different luminance.

9. The light bulb of claim 1, wherein the light bulb further includes a head housing having a screw-type adaptor and a power source contact, the screw-type adaptor and the power source contact are electrically insulating to each other, and the screw-type adaptor and the power source contact are respectively electrically connected to the driving module.

10. A light bulb, comprising:

a bulb housing and a head housing arranged in series along a longitudinal axis of the light bulb;

a first filament having a first LED chip capable of emitting a first light with a first color characteristics and a second filament having a second LED chip capable of emitting a second light with a second color characteristics, the first filament and the second filament are fixed to a conductor frame and intertwined together along a same transverse axis; and a driving module configured to provide a driving current to the first filament and the second filament via the conductor frame.

11. The light bulb of claim 10, wherein the bulb housing includes light transmissive material, and is configured to diffuse the first light emitted by the first filament and the second light emitted by the second filament.

12. The light bulb of claim 10, wherein the light bulb further comprises a core pillar, the core pillar includes a base, a first conductor frame, and a second conductor frame, the base of the core pillar is coupled to an opening of the bulb housing, the first conductor frame is electrically connected between the driving module and the first filament, and the second conductor frame is electrically connected between the driving module and the second filament.

13. The light bulb of claim 10, wherein the head housing includes a screw-type adaptor and a power source contact, the screw-type adaptor and the power source contact are electrically insulating to each other, and the screw-type adaptor and the power source contact are respectively electrically connected to the driving module.

14. The light bulb of claim 10, wherein the driver module includes a current provider and a selection circuitry, the current provider is configured to provide currents to the first filament and the second filament, and the selection circuitry is configured to selectively provide electrically connection between the current provider and the first filament, and between the current provider and the second filament.

15. The light bulb of claim 14, wherein the driver circuitry further comprises a tuning circuitry configured to control the current provider to provide the currents to the first filament and the second filament for emitting light of a desired luminance.

16. The light bulb of claim 15, wherein the tuning circuitry is configured to control the current provider to provide the currents to the first and the second filament so each of the filaments emits light with a different luminance.

17. The light bulb of claim 10, wherein the first light is red light and the second light is yellow light.

18. The light bulb of claim 10, wherein the first light has a first color temperature, and the second light has a second color temperature different from the first color temperature.

19. The light bulb of claim 10, wherein the light bulb further includes a third filament having a third LED chip capable of emitting a third light with a third color characteristics, the first filament, the second filament, and the third filament are spiral along the transverse axis.

20. The light bulb of claim 19, wherein the first light has a first color temperature, the second light has a second color temperature, the third light has a third color temperature, and the first color temperature, the second color temperature, and the third color temperature are different from each other.

* * * * *